US006313721B1

(12) United States Patent
Kitajima et al.

(10) Patent No.: US 6,313,721 B1
(45) Date of Patent: Nov. 6, 2001

(54) HIGH PERFORMANCE DIELECTRIC CERAMIC FILTER USING A NON-LINEAR ARRAY OF HOLES

(75) Inventors: Masahiko Kitajima; Kosuke Nishimura, both of Ube; Nobuhiro Harada, Yamaguchi, all of (JP)

(73) Assignee: Ube Electronics, Ltd., Mine (JP)

( * ) Notice: Subject to any disclaimer, the term of this patent is extended or adjusted under 35 U.S.C. 154(b) by 0 days.

(21) Appl. No.: 09/528,704

(22) Filed: Mar. 17, 2000

Related U.S. Application Data

(60) Provisional application No. 60/147,676, filed on Aug. 6, 1999.

(51) Int. Cl.[7] ..... H01P 1/20
(52) U.S. Cl. ..... 333/206; 333/202
(58) Field of Search ..... 333/202, 206, 333/207

(56) References Cited

U.S. PATENT DOCUMENTS

| | | | | |
|---|---|---|---|---|
| 4,431,977 | | 2/1984 | Sokola et al. . | |
| 4,450,421 | * | 5/1984 | Meguro et al. | 333/202 |
| 4,716,391 | | 12/1987 | Moutrie et al. . | |
| 4,954,796 | | 9/1990 | Green et al. . | |
| 5,428,325 | * | 6/1995 | Jachowski et al. | 333/203 |
| 5,675,301 | * | 10/1997 | Nappaet et al. | 333/202 |
| 5,739,733 | * | 4/1998 | Cameron | 333/202 |
| 5,783,980 | | 7/1998 | Blair et al. . | |

FOREIGN PATENT DOCUMENTS

593635 * 1/1993 (EP) .

* cited by examiner

*Primary Examiner*—Robert Pascal
*Assistant Examiner*—Patricia T. Nguyen
(74) *Attorney, Agent, or Firm*—Maxim H. Waldaum

(57) ABSTRACT

A high performance dielectric ceramic filter in a small package is designed with one or more holes positioned off of the straight-line bisecting at least two holes. This configuration allows for the elimination of at least one trap hole while maintaining a given performance characteristic for the filter. In one specific embodiment of the present invention the performance characteristics of a conventional five-hole ceramic filter is realized in a three-hole filter wherein the holes are positioned so as to form the vertices of a triangle. The width of the resulting filter is approximately 50% of the width of the conventional five-hole filter it can replace. In another embodiment the same triangular positioning may be used to realize the performance characteristics of a four-hole ceramic filter.

8 Claims, 5 Drawing Sheets

HIGH PERFORMANCE DIELECTRIC CERAMIC FILTER USING A NON-LINEAR ARRAY OF HOLES

CROSS-REFERENCE TO PROVISIONAL APPLICATION

The present invention claims the benefit of U.S. Provisional Application No. 60/147,676, filed on Aug. 6, 1999.

FIELD OF THE INVENTION

This invention relates to high performance ceramic block filters with a novel arrangement of resonators allowing for a smaller package than possible with conventional filters. In particular, by moving one or more resonators off of the straight line bisecting the two or more other resonators, it is possible to delete one or more resonator traps while maintaining performance.

BACKGROUND OF THE INVENTION

A ceramic body with a coaxial hole bored through its length forms a resonator that resonates at a specific frequency determined by the length of the hole and the effective dielectric constant of the ceramic material. The holes are typically circular, or elliptical. Combining multiple resonators may form a dielectric ceramic filter. The holes in a filter must pass through the entire block, from the top surface to the bottom surface. This means that the depth of a hole is the exact same length as the axial length of a filter. The axial length of a filter is selected based on the desired frequency and specified dielectric constant of ceramic.

The ceramic block functions as a filter because the resonators are inductively coupled and/or capacitively coupled between every two adjacent resonators. These couplings are formed by the electrode pattern designed on the top surface of the ceramic block, plated with a conductive material such as silver or copper. More specifically and with reference to FIGS. 10A–D, a ceramic block 101 is shown with two holes 103 and 105. All surfaces, except for the front open face 107 through which the two holes 103 and 105 extend, are plated with silver. Due to the size of the holes, their proximity and the conductive coating, the two holes 103 and 105 are inductively and capacitively coupled to each other. However, block 101 will not perform as a filter because these couplings cancel each other out.

To form a filter, a pattern of conductive material is printed on face 107, as shown in FIG. 10B. In this embodiment the patterns A and A enhance the capacitive coupling between holes 103 and 105. While the capacitive coupling is enhanced, the inductive coupling remains substantially unaffected. This is because inductive coupling is mostly a function of the hole diameter, shape and spacing between holes. These parameters are the same in FIGS. 10A and 10B.

The capacitive coupling can be regulated in FIG. 10B by adjusting parameters L and G. By decreasing G or increasing L, the capacitive coupling is strengthened. The capacitive coupling can also be weakened such that the inductive coupling is stronger, by printing line M on open face 107. The simple line M in FIG. 10C has a greater diminishing effect on the capacitive coupling of the block filter 101, than the broken line M of FIG. 10D.

Ceramic filters are well known in the art and are generally described for example in U.S. Pat. Nos. 4,431,977; 4,716,391; 4,954,796 and 5,783,980, all of which are hereby incorporated by reference as if fully set forth herein.

With respect to its performance, it is known in the art that the band pass characteristics of a dielectric ceramic filter are sharpened as the number of holes bored in the ceramic block are increased. The number of holes required depends on the desirable attenuation properties of the filter. Typically a simplex filter requires at least two holes and a duplexer needs more than three holes. This is illustrated in FIG. 1 where graph 10 represents the filter response with fewer holes than graphs 12 and 14. It is apparent that graph 14 which is the response of the filter with the most holes, is the sharpest of the three responses shown. Referring to FIG. 2, it can be seen that the band pass characteristic of a particular dielectric ceramic filter is also sharpened with the use of trap holes bored through the ceramic block. Solid line graph 21 represents the response of a filter without a high end trap. Dashed line graph 23 represents the response of the same filter with a high-end trap.

Trap holes, or traps as they are commonly referred to are resonators which resonate at a frequency different from the primary filter holes, commonly referred to simply as holes. They are designed to resonate at the undesirable frequencies. Thus, the holes transmit an input signal at the desirable frequencies while the traps remove the input signal at the undesirable frequencies, whether low end or high end. In this manner the characteristic of the filter is defined, i.e. high pass, low pass, or band pass. The traps are spaced from holes a distance greater than the spacing between holes so as to avoid mutual interference between the holes and traps. As shown in FIG. 3, whereas holes 31 are separated from each other a distance D, a distance of 2 D is placed between trap 33 and the hole nearest to trap 33. The precise distance D is one of design choice for achieving a specified performance. D typically falls within a preferred range of 1 to 10 mm. Traditionally, the traps will be spaced from 1.5 D to 2 D from the holes.

Conventionally the holes 41 and traps 43 in a ceramic filter are positioned along a straight line, as shown in FIG. 4. This design together with the spacing requirements addressed above limits the extent to which a filter may be reduced in size. Specifically, the performance characteristics of a given filter are a function of its width, length, number of holes and diameter of holes. The usual length is 2 to 20 mm. The width of a filter is a function of the number of holes in the filter. Typically, the width of the block filter ranges from 2 to 70 mm. Reducing the number of holes, the diameter of the holes, or the spacing between holes, will effect the performance of the filter. Accordingly, it is desirable to design a dielectric ceramic filter which can effectively reduce the size of a given filter while maintaining its given performance characteristics.

SUMMARY OF THE INVENTION

Accordingly, it is desirable to design a block filter in the smallest package possible without significant loss in performance as compared with a filter with a given number of holes, as conventionally designed. In accordance with the present invention a dielectric ceramic filter with a given performance characteristic can be reduced in size by eliminating one or more trap holes and positioning one or more holes off of the straight line bisecting at least two holes, as conventionally designed. The additional interactions between holes which are realized when one or more of the holes are positioned off the center line, provides the attenuating properties heretofore only possible with additional trap holes.

In one specific embodiment of the present invention the performance characteristics of a conventional five-hole ceramic filter can be realized in a three-hole filter wherein the holes are positioned so as to form the vertices of a triangle and within specific dimensions. The width of the resulting filter is approximately 50% of the width of the conventional five-hole filter it can replace. Other geometric arrangements are possible as well.

DETAILED DESCRIPTION OF THE INVENTION

Figure 1:
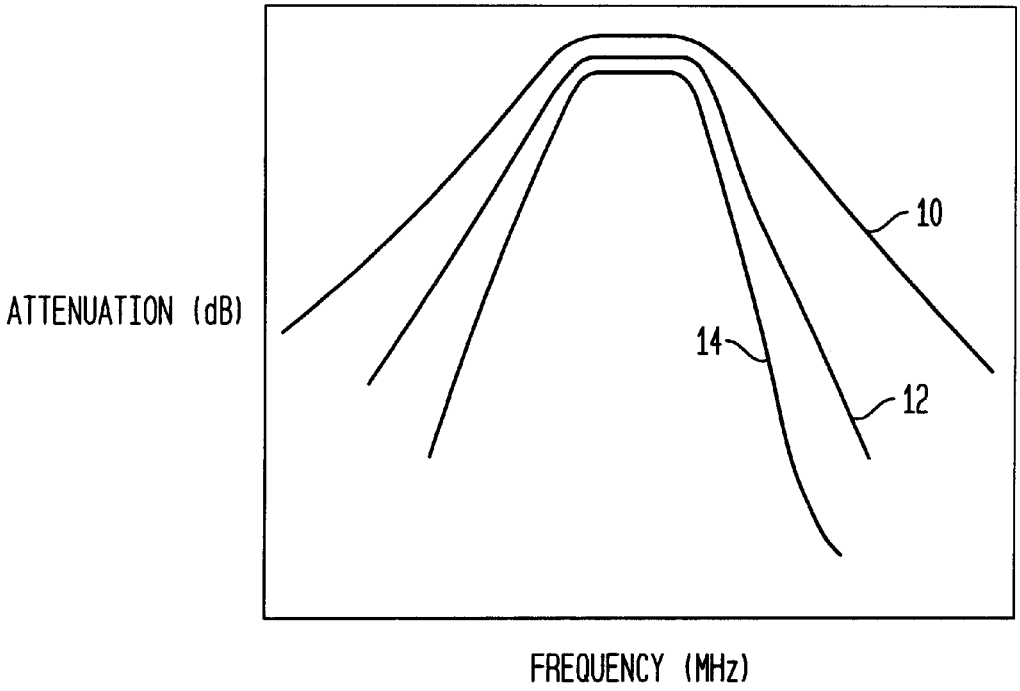
FIG. 1 illustrates the increased sharpness of the bandpass response of a dielectric ceramic filter as the number of holes in the filter increase.
Figure 2:
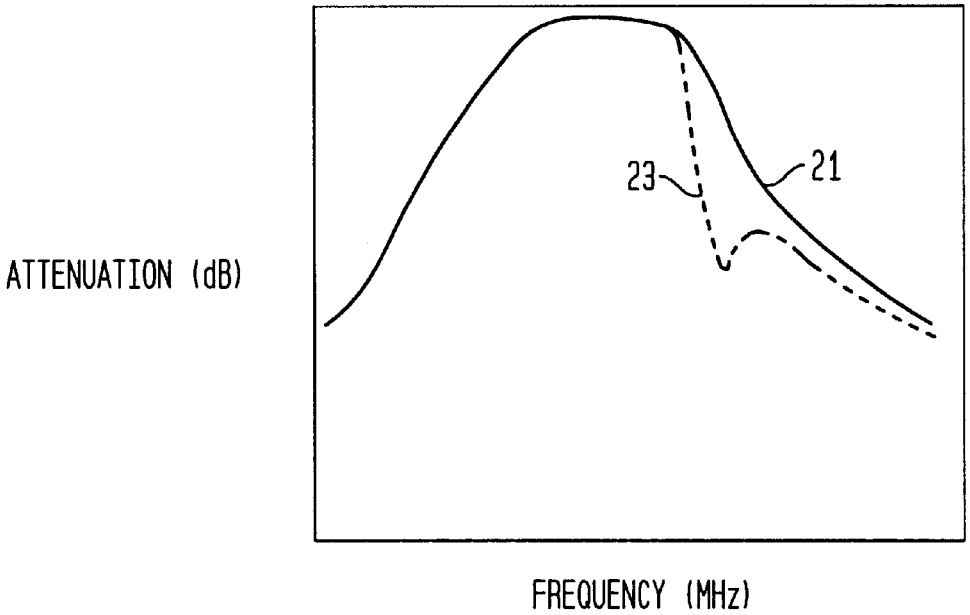
FIG. 2 illustrates the effectiveness of traps in removing high end frequencies.
Figure 3:
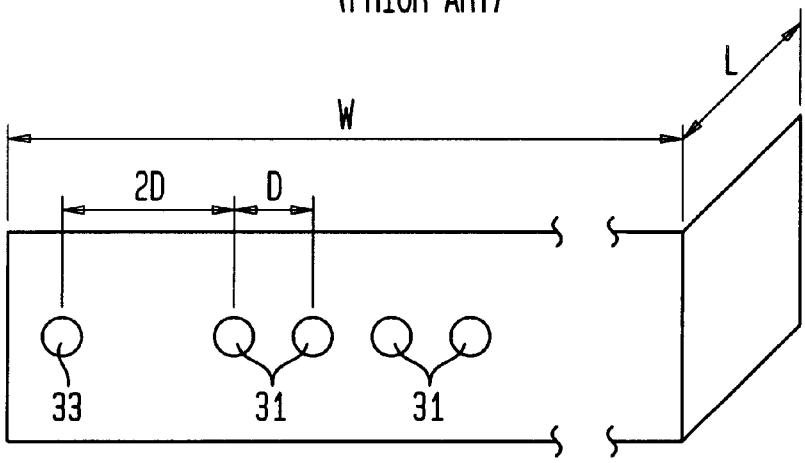
FIG. 3 (PRIOR ART)
FIG. 3 is representative of the spacing between holes and hole and trap on a conventional ceramic block filter.
Figure 4:
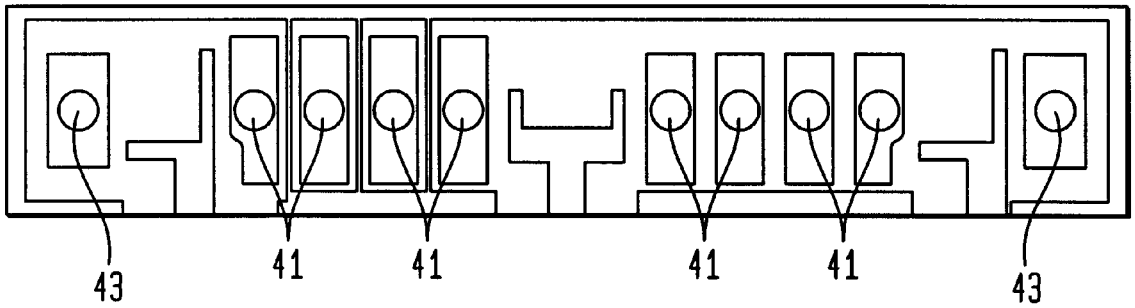
FIG. 4 (PRIOR ART)
FIG. 4 is a plan view of the top surface of one conventional dielectric ceramic filter with holes and traps positioned along a straight line.
Figure 5A:
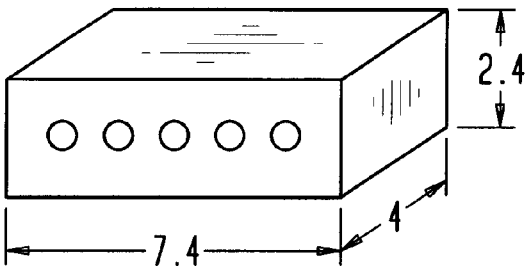
FIG. 5A (PRIOR ART)
FIG. 5A is an oblique view of a conventional five-hole dielectric ceramic filter with all holes lying on a straight line.
Figure 5B:
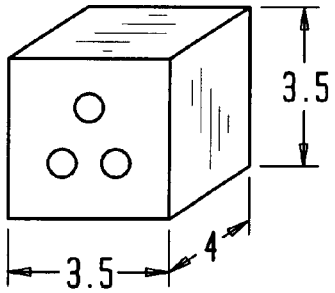
FIG. 5B is an oblique view of one embodiment of the present invention wherein the performance characteristics of the filter of FIG. 5A can be achieved in a dielectric ceramic filter with three holes and half the width in size.
Figure 6A:
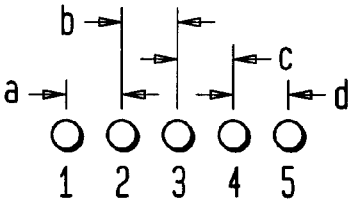
FIG. 6A (PRIOR ART)
FIG. 6A illustrates the interaction between the holes of the filter of FIG. 5A.
Figure 6B:
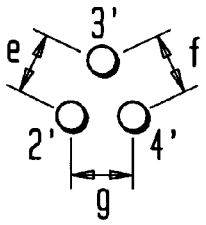
FIG. 6B illustrates the interaction between the holes of the filter of FIG. 5B.

Referring to FIG. 5A, a conventional five-pole filter is shown with a width of 7.4 mm. In accordance with the present invention, a smaller filter can be designed with three holes and a width of 3.5 mm, having the same characteristics as the filter of FIG. 5A. One such filter is shown in FIG. 5B. Referring to FIGS. 6A and 6B, the reduction in filter width is achieved by eliminating traps 1 and 5 and moving hole 3 off of the straight line formed conventionally by holes 2, 3 and 4. With the conventional straight-line configuration, only hole 3 would interact with hole 2 and hole 4. By moving hole 3 out of the straight line in accordance with the present invention, not only does hole 3 interact with holes 2 and 4, holes 2 and 4 interact with each other, as well. This additional interaction creates a trap effect, obviating the need for the end trap holes. The result is a ceramic filter with the properties of a five-pole filter, but in a smaller package.

Figure 7:
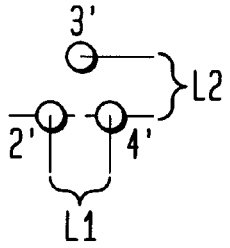
FIG. 7 further illustrates the relative spacing between holes of the filter of FIG. 5B.

The triangular ceramic filter of the present invention is preferably designed such that the three holes are positioned at the vertices of a triangle. The three hole configuration should be such that $L_2$ is equal or greater than 0.5 $L_1$, and equal or less than 1.5 $L_1$, where $L_1$ and $L_2$ are shown in FIG. 7. Furthermore, the holes should be no less than 1 mm from the edge of the ceramic block. For this particular embodiment, the characteristics that are usually realized with a five pole filter whose width is approximately 7 mm, can be realized with this embodiment with a width approximately 3 mm.

The triangular design of the present invention can be used to replace a four-hole filter as well. As noted above, the critical point is to design the holes and their relative position such that the added interaction achieved by moving an internal hole off of the conventional straight line performs as the trap that was eliminated.

Figure 8:
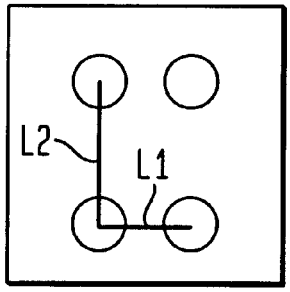
FIG. 8 illustrates a second embodiment of the present invention.
Figure 9:
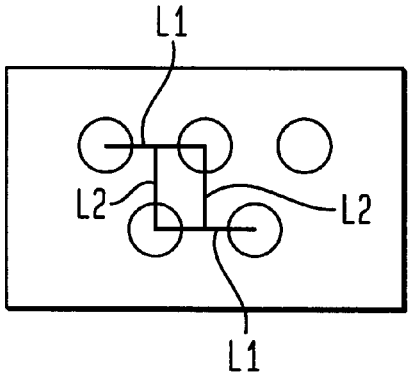
FIG. 9 illustrates a third embodiment of the present invention.
Figure 10A:
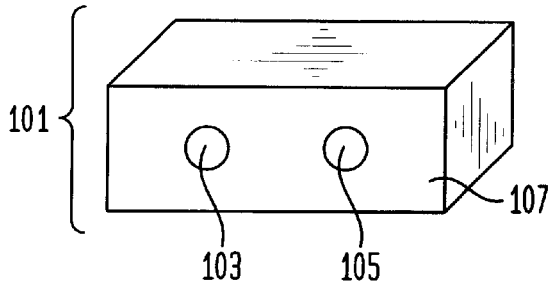
FIG. 10A illustrates the open face surface of a ceramic block plated with silver on all other surfaces.
Figure 10B:
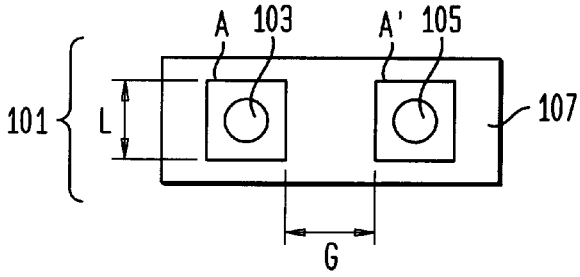
FIG. 10B illustrates the ceramic block of FIG. 10A, but with a printed pattern on the open face surface.
Figure 10C:
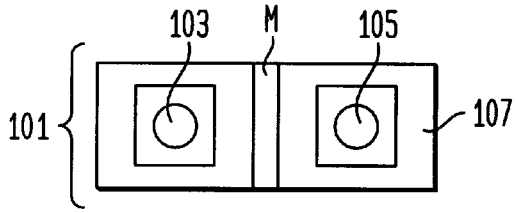
FIG. 10C illustrates the ceramic filter of FIG. 10B with a second printed pattern.
Figure 10D:
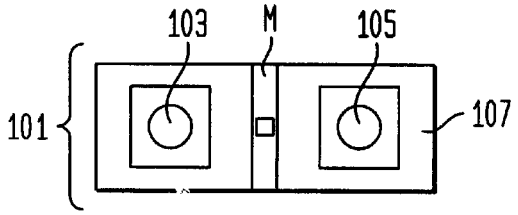
FIG. 10D illustrates the ceramic filter of FIG. 10C with a third printed pattern.

Following the foregoing principle, it is possible to design larger filters with additional holes in various configurations, such as those shown in FIGS. 8 and 9. Referring to the square four pole configuration shown in FIG. 8, the L1 and L2 dimensions are shown. Similar to the triangular configuration of FIG. 7, L2 should be no less than 0.5 L1 and no greater than 1.5 L1. Likewise, the configuration of FIG. 9 is effectively a concatenation of two triangular configurations, similar to that of FIG. 7. Here too L2 should be no less than 0.5 L1 and no greater than 1.5 L1. Furthermore, as with the triangular configuration, the holes for the configurations of FIGS. 8 and 9 should be at least 1 mm from the edge of the ceramic block.

The manufacture of block filters is known in the art, including the process of laying the conductive material on the dielectric. As stated above, copper or silver are usually the conductive materials of choice. The conductive material generally covers substantially all of the bottom, inside walls of the holes and outer side-walls of the ceramic block. This is accomplished by one of several known methods. These include dipping, spraying or printing a copper or silver paste onto the dielectric and firing the coated dielectric. Other methods include Electrolytic plating or Electroless plating, also processes known in the art.

Filters made in accordance with the present invention may be simplex (a single filter) or duplexer (the combination of two filters such as a transmitter filter and a receiver filter).

The foregoing merely illustrates the principles of the present invention. Those skilled in the art will be able to devise various modifications, which although not explicitly described or shown herein, embody the principles of the invention and are thus within its spirit and scope.

What is claimed is:

1. A filter, comprising:

a block of dielectric material having a top surface, a bottom surface, two opposing side-walls connecting said top surface to said bottom surface along the width of said block and two opposing side-walls connecting said top surface to said bottom surface along the height of said block;

at least three holes extending through said block of dielectric material from said top surface to said bottom surface, at least one of said three holes positioned along said top surface of said dielectric material such that the center of all of said holes do not lie on a single straight line, said at least three holes spaced one from the other so as to achieve a bandpass characteristic similar to a conventional filter with at least one more hole than said at least three holes, wherein the center of each of said holes of said conventional filter lie substantially on a single straight line; and conductive material substantially covering said bottom surface, side-wall surfaces and inner surfaces of said at least three holes.

2. The filter of claim 1 further comprising an electrode pattern of conductive material on said top surface of said block of dielectric material so as to electrically couple each of said at least three holes to an adjacent one of said at least three holes.

3. The filter of claim 1 wherein three of said at least three holes are arranged on said top surface of said block of dielectric material so as to appear as the vertices of a triangle.

4. The filter of claim 3 wherein said three holes forming a triangle are spaced such that the distance from one of said holes to the line connecting the center of the other two of said three holes is greater than half the distance between said other two holes and less than one and one half the distance between said other two holes.

5. The filter of claim 1 further comprising at least a fourth hole and wherein said at least four holes are arranged on said top surface of said block of dielectric material so as to form the corners of a rectangle.

6. The filter of claim 5 wherein the distance between the centers of two of said four holes forming a first edge of said rectangle is not less than one half the distance between the centers of two of said four holes forming a second edge of said rectangle, and not greater than one and one half times the distance between the centers of said two holes forming said second edge, said second edge being perpendicular to said first edge.

7. The filter of claim 1 wherein said at least three holes are arranged in at least two rows running the width of said top surface of said dielectric material.

8. The filter of claim 7 wherein adjacent rows of said at least two rows are offset one from the other and wherein the distance between the centers of adjacent holes in two adjacent rows is not less than one half the distance between the centers of two adjacent holes of a single row and not greater than one and one half the distance between the centers of two adjacent holes of a single row.

* * * * *